US005353440A

United States Patent [19]

Meldeau

[11] Patent Number: 5,353,440

[45] Date of Patent: Oct. 11, 1994

[54] GRIP GLOVE

[76] Inventor: William B. Meldeau, 200 Pacific Coast Hwy., #245, Huntington Beach, Calif. 92648

[21] Appl. No.: 12,650

[22] Filed: Feb. 3, 1993

[51] Int. Cl.[5] ..... A41D 19/00

[52] U.S. Cl. ..... 2/161.1; 2/161.6; 294/25

[58] Field of Search ..... 2/16, 17, 20, 21, 159, 2/160, 161.1, 161.5, 161.6; 441/68, 69; 294/25, 26; 280/816, 819, 821, 822; 273/166, 54 B, 26 C; 482/23, 48, 49, 105, 106

[56] References Cited

U.S. PATENT DOCUMENTS

| | | | |
|---|---|---|---|
| 2,877,465 | 3/1959 | Stroud | 2/20 |
| 4,400,831 | 8/1983 | Rietz | 2/161 A |
| 4,720,279 | 1/1988 | Fritschen | 2/161 A |
| 5,004,231 | 4/1991 | Alread | 2/159 |
| 5,182,814 | 2/1993 | Christensen | 2/161.1 |
| 5,298,001 | 3/1994 | Goodson | 2/161.1 |

FOREIGN PATENT DOCUMENTS

| | | | |
|---|---|---|---|
| 2626559 | 8/1989 | France | 2/16 |

*Primary Examiner*—Clifford D. Crowder
*Assistant Examiner*—Michael A. Neas
*Attorney, Agent, or Firm*—Aquilino & Welsh

[57] ABSTRACT

A glove and auxiliary grip including a protuberance on a grip strap to provide a bearing surface against a cylindrical object which exerts a force on a user. The glove includes universally adjustable separable fasteners to position the glove on a hand of the user and an adjustable wrist strap to provide a secure connection between auxiliary grip and the stronger arm muscles of the user.

13 Claims, 3 Drawing Sheets

GRIP GLOVE

BACKGROUND AND SUMMARY OF THE INVENTION

The prior art attempts to provide gripping gloves and gripping devices are shown in the prior art. For example, the patent to Fritschen et al. (U.S. Pat. No. 4,720,279) is directed to a water sport and grip hook to assist a wearer in firmly gripping the handle of, for example, a ski rope to eliminate hand and arm fatigue. The device includes a grip strap of webbing material for patents at a 45° angle to the wrist. A palm or grip strap which encircles a dowel sewn in a loop to provide a protuberance rib which extends transversely to the strap. The Fritschen et al. device also includes a variety of embodiments of finger engaging devices, such as loops, channels, finger cups, or the like.

Another patent to Rietz (U.S. Pat. No. 4,400,831) shows a glove arrangement particularly for water skiing, which includes a grip device attached to the palm of a full glove using a dowel on the end of a strap secured to the entire length of the glove from the wrist to the fingers. The dowel strap is not moveable, and therefore can only be used in one way, where the cylindrical object, or grip handle, is in the palm of the user's hand.

Other patents of interest include the patent to Swanson (U.S. Pat. No. 4,000,903), which shows a golf glove having a raised bead extending across the palm portion to abut the grip of a golf club shaft and guide the hand of a golfer to a proper grip position.

The patent to Stroud (U.S. Pat. No. 2,877,465) shows a golf glove having a hook member attached to the wrist portion of the glove, which engages the shaft of a golf club to enhance the grip of the user.

Another patent of interest is to Farnsworth (U.S. Pat. No. 3,417,840), which shows a safety hook attached to the wrist of the glove, which is structured to engage the rungs of a ladder to aid the user in maintaining a grip of the rung.

The present invention is directed to an improved glove and auxiliary grip to a user to grasp a cylindrical object which exerts a force on the user. The glove and auxiliary grip is particularly adapted to aid a user when water skiing to help the skier maintain a firm grip on the cylindrical ski rope handle and/or to aid a user when weight lifting to maintain a grip on a barbell bar when the barbell weight is lifted. Other similar uses are contemplated, as for example, using the glove and grip to lift heavy objects in the construction and manufacturing trades.

Preferably, the glove is fingerless and thumbless, and includes a padded palm section. The glove includes a pair of tab panels attached to the palm section which overlay the back of the hand of the user, a wrist band and a wrist strap having a universally adjustable fastener system to precisely and securely attach the glove to the hand of a user.

The tab panels are adjustably interconnected using a hook and loop type separable fastener. The wrist band has a hook and loop fastener for initially positioning the wrist band on the wrist of the user. The wrist strap includes an adjustably positioned hook and loop separable fastener which is connected through a D-ring and folded back upon itself to secure the glove at the wrist.

The auxiliary grip includes a grip strap having a fixed end securely fastened to the wrist strap below the padded palm and a free end terminating in a cylindrical loop for holding a correspondingly sized, cylindrically-shaped protuberance such as a wooden or plastic dowel. The grip strap includes one element of still another hook and loop separable fastener which cooperates with a complimentary separable fastener element on the wrist strap which enables the grip strap to be folded back away from the padded palm when it is not being used.

Among the objects of the present invention is the provision of a thumbless and fingerless glove having an auxiliary grip to aid a user in griping a cylindrical member exerting a force on the hand of the user; the provision of such a glove having a unique fastener system for attaching the glove to the hand of the user; and, the provision of such a glove wherein the fasteners of the fastener system are universally adjustable, enabling the glove to be precisely and securely secured to the hand of a user to obtain maximum effectiveness of the auxiliary grip. These and other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
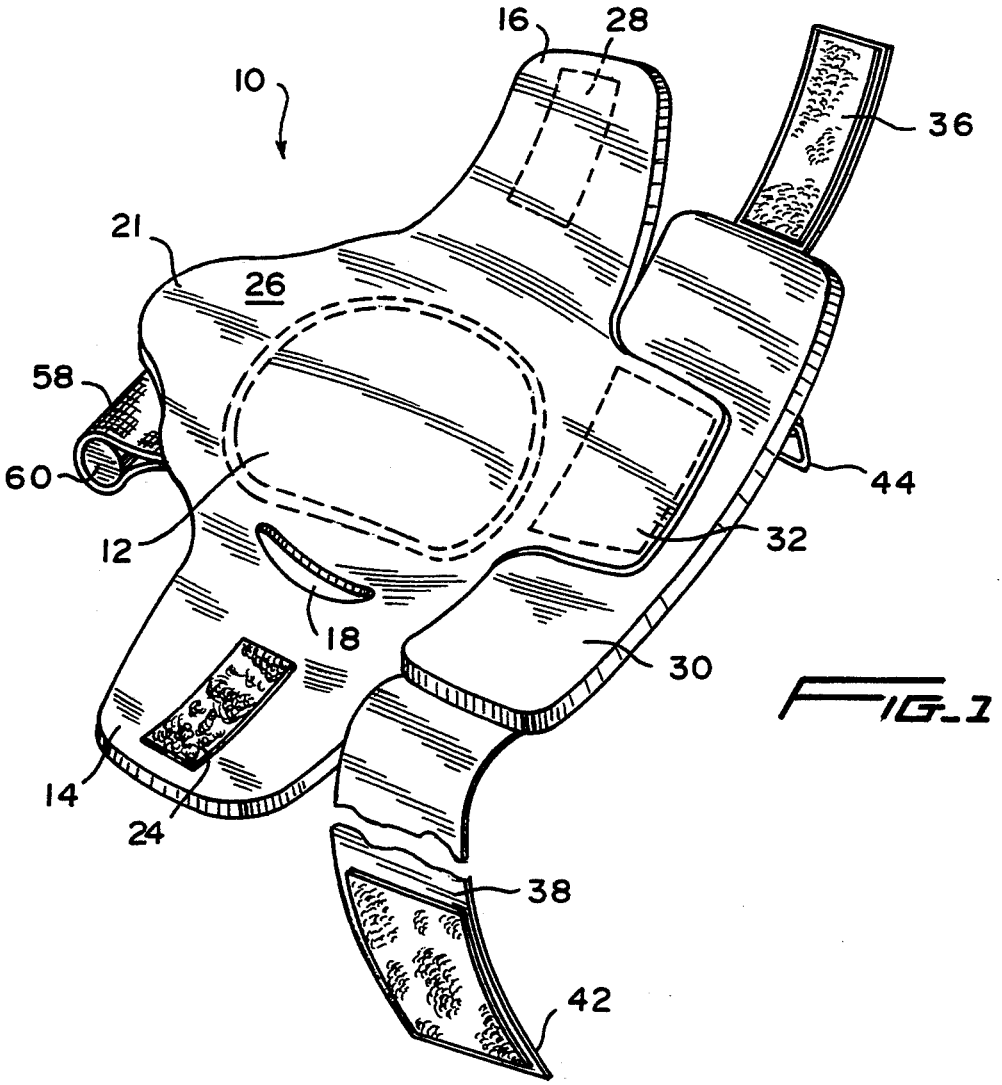
FIG. 1 is a perspective view of a glove of the present invention, shown in an open position.
Figure 2:
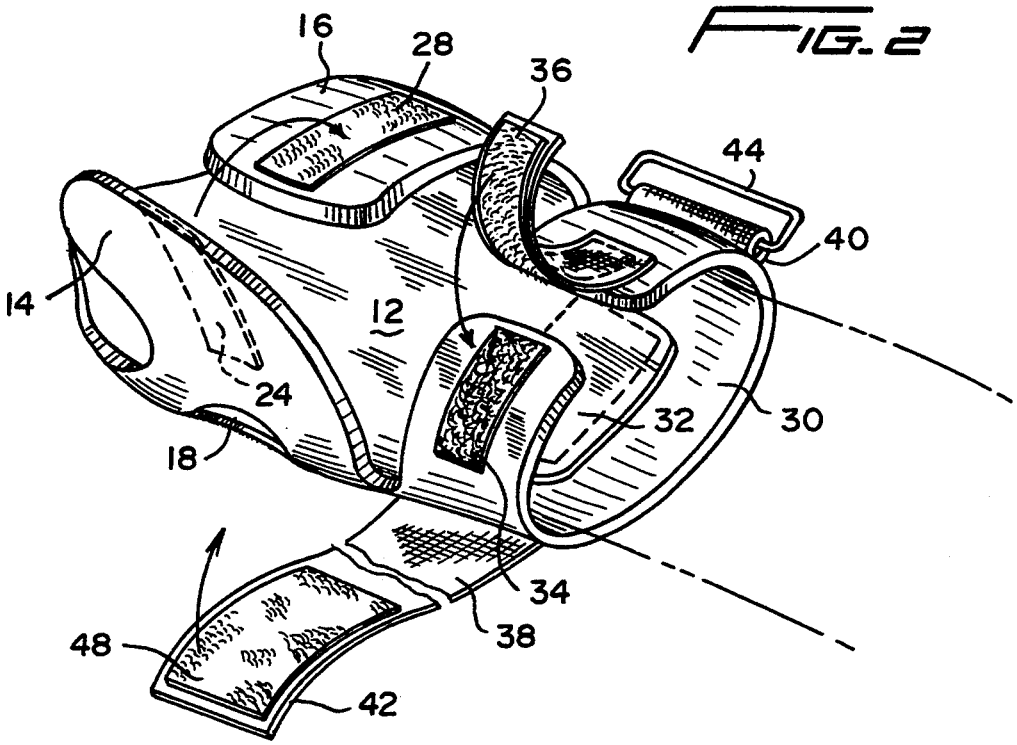
FIG. 2 is a perspective view of the glove, showing the position of the closure members with the glove on the hand of a user.
Figure 3:
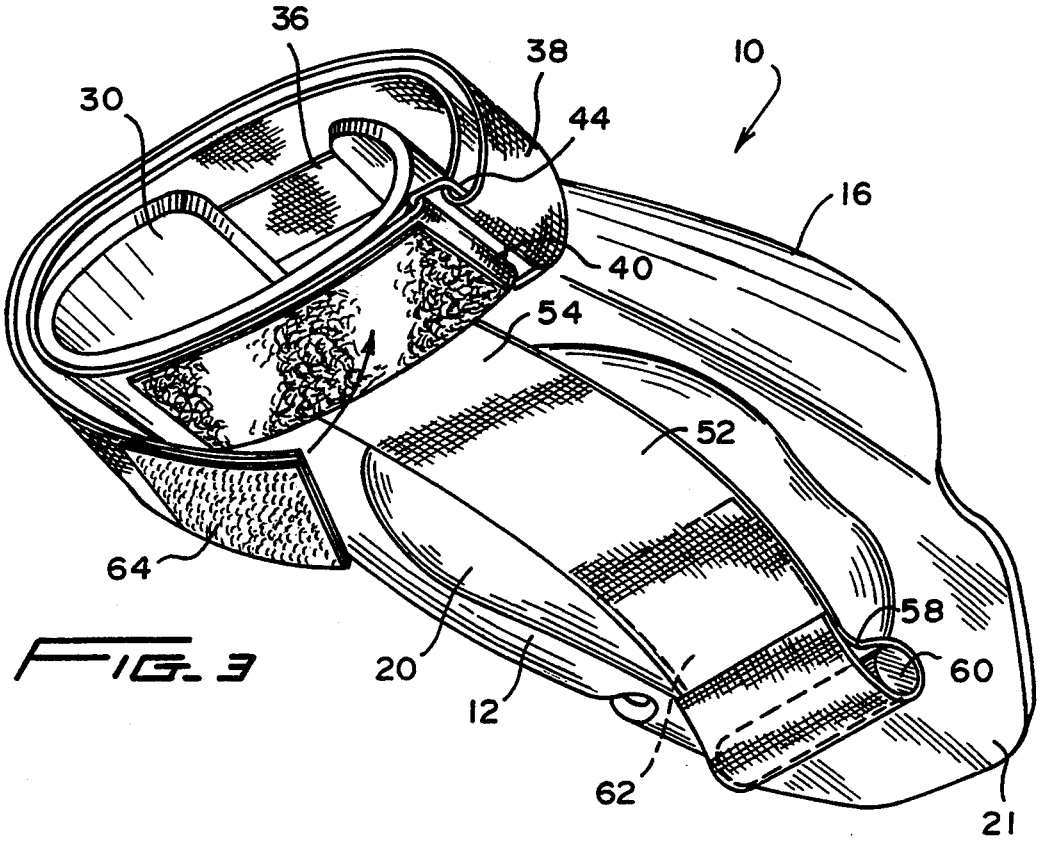
FIG. 3 is a perspective view of the palm side of the glove, with the glove in a closed position.
Figure 4:
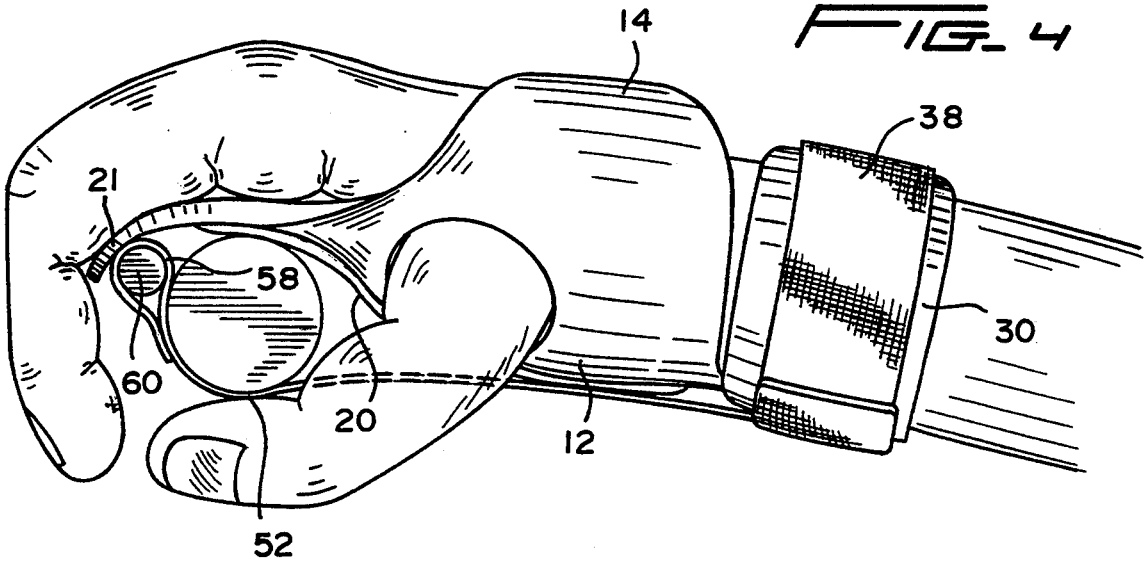
FIG. 4 is a side perspective view showing the glove used to hold a cylindrical object.
Figure 5:
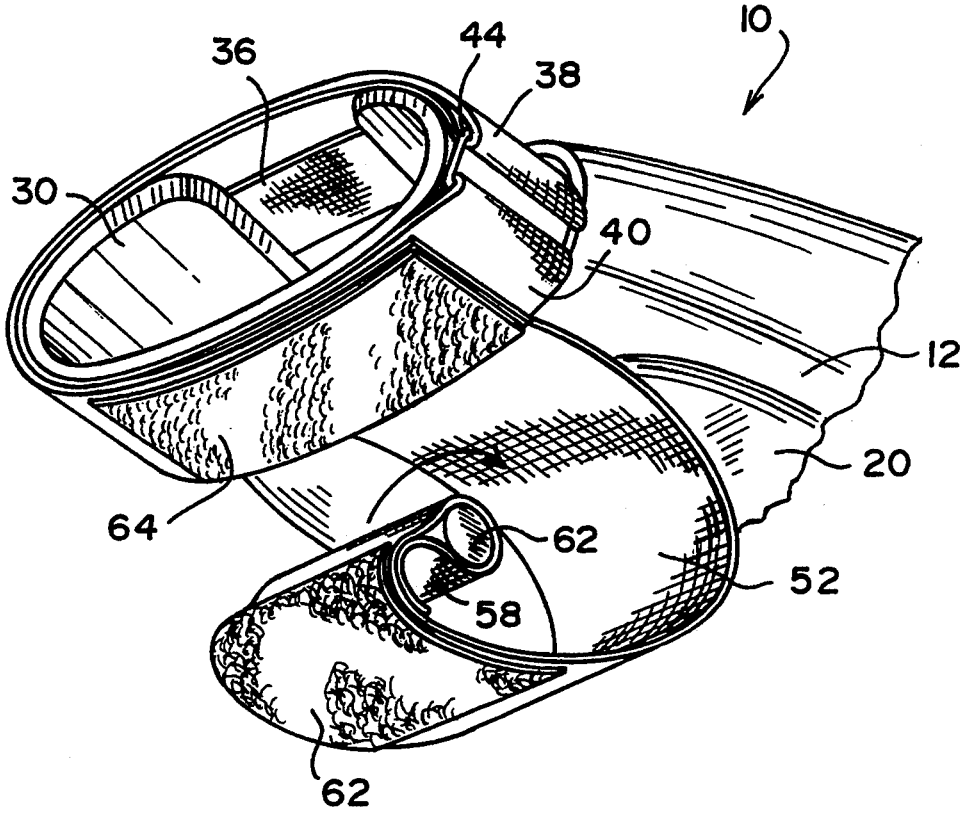
FIG. 5 is a perspective view of a detail of the glove of FIG. 1.
Figure 6:
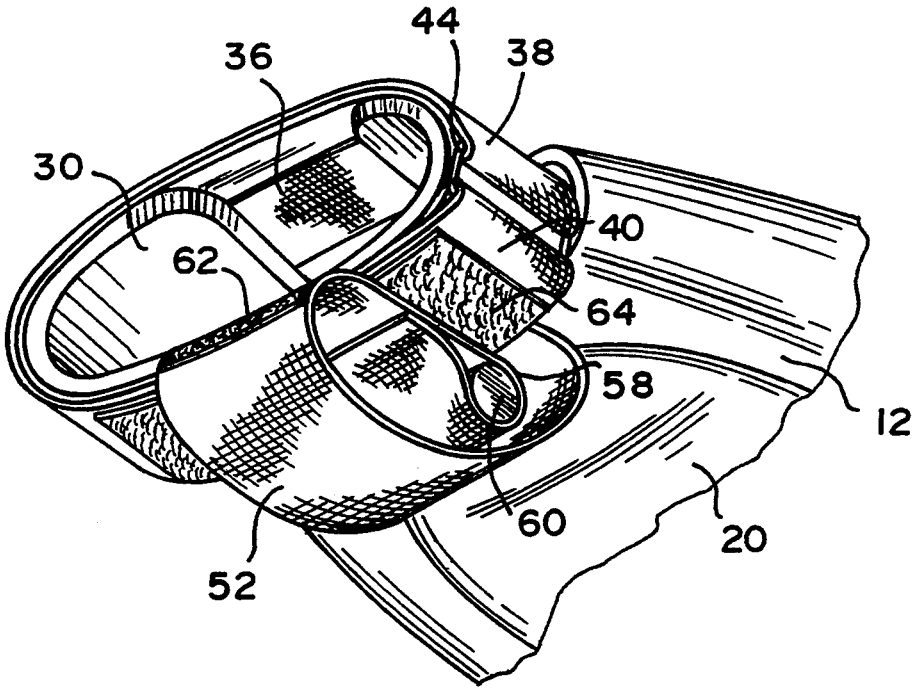
FIG. 6 is a perspective view of the detail of FIG. 5 with the auxiliary grip in a non-use position.

Referring to the drawings, the fingerless and thumbless glove 10 of the present invention is formed of a palm 12, a pair of integrally attached tab panels 14 and 16 laying along opposite edges of the palm 12; a first tab panel 14 being on a thumb side of the palm 12 and a second tab 16 being on an ulnar side of the palm 12. A thumb hole 18 is located between the palm 12 and the thumb tab panel 14 for insertion of a user's thumb when the glove 10 is worn. The palm 12 is provided with a pad 20 on an outerside 22 of the glove 12 to minimize the stresses of the force exerted by an object being lifted or pulled. The shape of the palm 20 includes a hump 21 at the finger end which extends to cover the first finger joints of the hand of the user to protect this area when a cylindrical object is lifted or applies a force to the user's hand. The shape of the hump 21 eliminates the tendency of these types of gloves to bunch up under the cylindrical object, causing discomfort to the user.

When the glove 10 is worn by a user, the tab panels 14 and 16 overlay the back of the hand of the user and are adjustably positioned and secured by a hook and loop type separable fastener formed of a first hook and loop element 24 formed on an innerside 26 of the glove 10 and a second complementary hook and loop type element 28 formed on the outerside 22 of the glove 10. It will be appreciated that a hook type or loop type fastener element may be interchangeably used with equal effectiveness. Similarly, the fastener elements may be provided on either the outerside 22 or innerside 26 of the glove 10, as long as they are complementary and fasten to each other when the tab panels 14 and 16 overlay across the back of the hand of user.

The glove 10 is provided with a wrist band 30 integrally formed with or attached to a heel edge 32 of the palm 12. The wrist band 30 is provided with a wrist band fastener formed of a hook and loop type element 34 attached to one end of the wrist band 30 and a complementary hook and loop strap 36 attached to an opposite end of the wrist band 30. When the wrist band 30 is wrapped around the wrist of a user, the wrist band 30 is held in place by securing the hook and loop type separable wrist band fastener.

A wrist strap 38 has a first end 40 fixed to the wrist band 30 on the outerside 22 of the glove 10. The wrist strap 38 is approximately twice the length of the wrist band 30 and includes a free end 42 designed to wrap around itself after passing through a D-ring 44 secured to the fixed end 40 of the wrist strap 38. The wrist strap 38 is made with a heavy duty strap material, enabling it to withstand the forces exerted upon it when the glove is used. A hook and loop type fastener element 46 is secured to the fixed end 40 of the wrist strap 38 adjacent the D-ring 44. A second hook and loop type fastener element 48 is attached to the free end 42 of the wrist strap 38.

When the glove 10 is positioned on the hand of a user and the tab panels 14 and 16 and the wrist band 30 are fastened using their respective separable fasteners, the wrist strap 38 is adjustably secured by passing the free end 42 of the wrist strap through the D-ring and folding it back upon itself so the complementary hook and loop fastener elements 46 and 48 on the fixed end 40 and free end 42 of the wrist strap 38 respectively, are secured together. It will be appreciated that the tautness of the wrist strap 38 is adjustable in accordance with how much of the free end 42 of the wrist strap 38 is pulled through the D-ring 44. It can be seen that the glove 10 of the present invention is universally useable by a wide variety of users having different sized hands, since all of the fasteners of the glove are universally adjustable. This enables a user to obtain a precise, secure and comfortable fit to minimize fatigue and maximize a user's gripping ability when using the glove.

An auxiliary grip 50 includes a grip strap 52 having a fixed end 54 secured proximate a midline passing through the palm 12 to the fixed end 40 of the wrist strap 38 and preferably between the wrist strap 38 and the wrist band 30 to insure maximum rigidity and strength at the connection point. An opposite free end 56 of the grip strap 52 is formed with a cylindrical loop 58 to accommodate a protuberance such as a cylindrical element 60 which may be a wooden or plastic dowel. The grip strap 52 extends longitudinally along the midline of the palm to a point where the cylindrical element 60 is located just past the first finger joints. With the glove 10 in place on the user's hand and the wrist strap securely fastened, the auxiliary grip 15 is used when lifting, pulling or holding a cylindrical object which exerts a pulling force on a user such as a ski rope handle or barbell bar. The cylindrical object is held in the palm of the hand and the free end of the grip strap is wrapped around the object being gripped. Because the grip strap is free, the object may be positioned on either side of the grip strap 12 so that the cylindrical element 60 abuts the cylindrical object being gripped, which provides a bearing surface connected directly to the lower arms and wrist of the user through the attachment of the grip strap 52 to the wrist strap 38. This allows the force exerted by the object being gripped to be taken up by the larger muscles in the arms rather than the weaker muscles in the fingers.

The auxiliary grip strap 52 includes another separable fastener element 62 which cooperates with a separable fastener element 64 formed on the free end 42 of the wrist strap 38 on the opposite side of fastener element 48. This enables the auxiliary grip to be folded back away from the glove palm 20 and secured to the wrist strap 38 when it is not being used.

It will be appreciated that the principles of the present invention are applicable to other types of gloves, such as full finger types. Also, the invention is not limited to the exact fastener configuration shown in the drawings, but it is appreciated that various fastener elements and positions thereof are interchangeable. Other modifications and changes are contemplated in keeping within the spirit and scope of the following claims.

I claim:

1. The combination of a glove and auxiliary grip for grasping a cylindrical object exerting a pulling force on a user comprising:

said glove having an upperside and an underside;

a palm section forming a covering for the palm of the hand of the user and extending from the fingers to the heel of the hand of the user;

a pair of tab panels, one of each of said pair being integrally connected to said palm section, said tab panels including an adjustable tab panel separable fastener for connecting said panels together, said tab panels overlaying each other and forming a backhand portion of the glove when in place on the hand of a user;

a wrist band connected to said palm section adjacent the heel of a hand when worn; said wrist band including an adjustable wrist band separable fastener for securing the wrist band around the user's wrist;

a wrist strap having a fixed end secured to said wrist band and a free end;

a wrist strap separable fastener including a separable fastener element connected adjacent said fixed end of said wrist strap and a complimentary separable fastener element connected to said free end of said wrist strap, whereby said wrist strap is wrapped around and overlays said wrist band to provide a rigid connection to a user's wrist; and, an auxiliary grip including a grip strap having one end fixed to said wrist strap and a free end extending longitudinally proximate a midline of said palm section, said free end terminating in a protuberance forming a bearing surface for said cylindrical object exerting a pulling force.

2. The combination of claim 1 wherein said grip strap includes a cylindrical sleeve formed on the free end thereof; said protuberance being sized to be maintained in said cylindrical sleeve.

3. The combination of claim 1 further including a D-ring attached to said fixed end of said wrist strap;, said free end of said wrist strap structured to pass through said D-ring and fold back upon itself to adjustably join said wrist strap separable fasteners.

4. The combination of claim 1 wherein said tab panel separable fastener includes a first separable fastener element on an upperside of one of said pair of tab panels and a second separable fastener element on an underside of a second said pair of tab panels whereby said tab panels may be adjustably secured to each other.

5. The combination of claim 1 wherein said wrist band separable fastener includes a first separable fastener element connected to one end of said wrist band and a second complementary separable fastener element strap having a fixed end connected to a second opposite end of said wrist band and a free end for connection to said first separable fastener element.

6. The combination of claim 1 wherein said protuberances is a cylindrical rod and said grip strap further includes a sleeve formed on said free end thereof; said cylindrical rod being maintained in said sleeve.

7. The combination of claim 1 further including a grip strap separable fastener having a first separable fastener element adjacent said free end of said grip strap and a second complementary separable fastener element formed on said wrist strap whereby said grip strap may be secured to said wrist strap away from said palm section.

8. The combination of claim 7 wherein said separable fasteners are formed with at least one hook type separable fastener element and at least one complimentary loop type separable fastener element.

9. The combination of claim 1 wherein said glove is fingerless and thumbless.

10. The combination of claim 9 further including a thumb hole formed between said palm section and one of said pair of tab panels.

11. The combination of claim 1 further including a pad formed on said palm section for protecting a user's hand from the pulling force of said cylindrical object.

12. The combination of claim 1 further including a hump at a finger end of the palm section covering first finger joints of the hand of the user.

13. The combination of claim 1 wherein said auxiliary grip strap includes an auxiliary grip strap separable fastener element and said wrist strap includes a complementary auxiliary grip strap separable fastener element whereby said auxiliary grip strap may be secured to the wrist strap away from the palm section when it is not in use.

* * * * *